US005343941A

United States Patent [19]

Raybon

[11] Patent Number: 5,343,941

[45] Date of Patent: Sep. 6, 1994

[54] APPARATUS FOR TREATING OIL AND GAS WELLS

[76] Inventor: Michael L. Raybon, 2711 Rebecca St., Big Spring, Tex. 79720

[21] Appl. No.: 985,136

[22] Filed: Dec. 3, 1992

[51] Int. Cl.[5] ..... E21B 43/00

[52] U.S. Cl. ..... 166/53; 166/65.1; 166/75.1

[58] Field of Search ..... 166/75.1, 65.1, 304, 166/53

[56] References Cited

U.S. PATENT DOCUMENTS

| | | | |
|---|---|---|---|
| 1,531,173 | 3/1925 | Brady . | |
| 1,602,190 | 10/1926 | Eddy . | |
| 2,089,035 | 8/1937 | Oberlin . | |
| 2,654,436 | 10/1953 | Carlisle et al. . | |
| 2,884,067 | 4/1959 | Marken . | |
| 3,053,320 | 9/1962 | Steincamp | 166/75.1 |
| 3,710,867 | 1/1971 | Bansbach | 166/75.1 |
| 4,064,936 | 12/1977 | McClure | 166/75.1 |
| 4,071,278 | 1/1978 | Carpenter et al. | 166/65.1 X |
| 4,132,268 | 1/1979 | Harrison | 166/75.1 X |
| 4,243,528 | 1/1981 | Hubbard et al. | 166/75.1 X |
| 4,354,553 | 10/1982 | Hensley . | |
| 4,681,167 | 7/1987 | Soderberg | 166/304 X |
| 4,817,722 | 4/1989 | Montfort, Jr. et al. . | |
| 4,830,112 | 5/1989 | Erickson | 166/304 |
| 4,836,286 | 6/1989 | Edwards | 166/304 |
| 4,876,018 | 10/1989 | Karydas | 166/304 X |

*Primary Examiner*—Ramon S. Britts
*Assistant Examiner*—Frank S. Tsay
*Attorney, Agent, or Firm*—Richard C. Litman

[57] ABSTRACT

An apparatus for treating oil and gas wells having a tubing string extending into the earth's surface for the removal of fluids; from a hydrocarbon productive reservoir and a casing string surrounding the tubing string for protective purposes with a measured volume of treating fluid. The instant apparatus includes: a chemical treatment fluid storage tank in fluid communication with a mixing vessel, a chemical pump for transporting chemical treatment fluid from the storage tank to the mixing vessel, a remote actuating and timing mechanism and associated valves, a mixing vessel, and flow lines connecting the assembled apparatus to a well. When in use, produced well fluids may be diverted to the mixing vessel containing treatment fluid supplied by the pump thereby causing the contents of the vessel to be flushed into the casing/tubing annulus of the well for treatment purposes. Discharge of fluids from the mixing vessel is halted by returning the valve linking the tubing string and the vessel to a closed position. Upon closure of the valve, the mixing vessel will be returned to a fluid packed condition whereby the vessel is essentially filled with produced well fluids. The chemical injection pump is then activated to deliver a predetermined volume of treatment fluid from the storage tank to the mixing vessel for discharge at a later time.

10 Claims, 1 Drawing Sheet

12
14
18
20
39
17
18
41
38
43
41
16
24
49
46
48
34
36
25
43
28
10
24
17
40
28
45
50
54
26
30
32
22
44

APPARATUS FOR TREATING OIL AND GAS WELLS

FIELD OF THE INVENTION

The present invention relates generally to equipment for the production of hydrocarbon fluids in an oil field. In particular, an apparatus for automatically feeding a measured quantity of treating liquid into the casing/tubing annulus of a producting oil and gas well is disclosed. Frequency of treatment may be varied by resetting the actuating and timing mechanism of the apparatus.

BACKGROUND OF THE INVENTION

Many corrosive agents are present in the fluids produced from oil and gas wells. Although varying in concentration from place to place, these corrosive agents are known to cause damage to the metallic components of such wells if unchecked. Production tubing, because of its continuous exposure to produced reservoir fluids, has been found to be particularly vulnerable to damage. To inhibit corrosion, well-known treatment chemicals are commonly introduced into the annulus formed between the well's production tubing and casing, the chemicals then flowed toward the bottom of the well and returned to the surface with the produced fluids. In this manner, the life of vulnerable pumping equipment may be extended and well downtime reduced considerably.

In other producing oil and gas wells, paraffin or scale build-up is a problem. Paraffin, a waxy solid deposited upon the walls of well fluid containment surfaces, commonly obstructs the flow of fluid within the tubing, flow lines, and other related components of the well. Similarly, scale deposits having a variety of compositions are known in certain areas to form on production equipment surfaces, sometimes substantially reducing the performance of downhole pumps and the like. As with undesirable corrosion, paraffin or scale build-up may also be checked by introducing appropriate chemical treatment fluids into the wellbore.

Typically, the volume of well treatment fluids used to treat a hydrocarbon productive well is small. Amounts ranging from several milliliters to several liters are usually employed during each treatment. Because small fluid volumes are somewhat difficult to transport, it is frequently necessary to utilize auxiliary fluids for flushing the chemicals into the wellbore and to insure adequate distribution over the surfaces to be protected.

In treating a well, a predetermined volume of treatment fluid is introduced into the wellbore at regulated intervals of time. Depending on the severity of the conditions to be alleviated, the treatment fluid may be introduced into the wellbore on an hourly, daily, or even weekly schedule. The actual treating period during which the treatment fluid is maintained in the well may range from several minutes to several hours.

DESCRIPTION OF THE RELATED ART

Several methods are presently utilized for the chemical treatment of producing oil and gas wells. One method involves the continuous flow of treatment chemicals into the well, at a low rate of flow, where such may mix with produced well fluids. Once mixed, the fluids may be drawn back to the surface through the well's production tubing. This continuous treatment approach, as is generally conceded by those employing it, generally requires the use of unnecessarily large volumes of costly treatment chemicals and is for this reason somewhat undesirable. Another method involves the introduction of relatively large volumes or slugs of chemical treatment fluids into a wellbore on a periodic basis. Most frequently, a tank truck, containing well treatment fluids, is driven to a given well on an "as needed" basis and is permitted to discharge a portion of its contents therein. Automated apparatus, on the other hand, .have been developed to reduce the amount of human intervention associated with trucks or other land vehicles and are capable of delivering fluids to the casing/tubing annulus in continuous or slug form.

For instance, U.S. Pat. No. 1,531,173, issued Mar. 24, 1925 to John D. Brady, describes e process for the prevention of petroleum emulsions in a well wherein chemicals, stored in a remote tank, are continuously injected into a wellbore. Chemicals, such as surfactants and water softeners, may be released into the casing/tubing annulus at the wellhead utilizing a gravity feed or pumped to a location opposite the hydrocarbon producing reservoir through a separate tubing string. A valve may be provided in the flow line connecting the tank to the wellhead a check to fluid flow.

U.S. Pat. No. 1,602,190, issued Oct. 5, 1926 to Harold C. Eddy et al, discloses a method for dehydrating petroleum emulsions wherein produced natural gas is passed through; a series of separators to remove hydrocarbon liquids, compressed, and directed into the casing/tubing annulus under pressure as part of a gas lift system. Prior to entering the wellbore, the dry gas is passed through an atomizer having a nozzle for the delivery of a suitable de-emulsifying agent to the gas stream. The gas, having the de-emulsifying agent in the form of a very finely divided mist in suspension, may flow into the well tubing through a gas lift port provided for this purpose.

U.S. Pat. No. 2,08,035, issued Aug. 3, 1937 to William Oberlin, shows a process for treating well fluids within the wellbore. A pump or other suitable means is employed in the process to deliver a water-insoluble reagent into a water supply conduit in fluid communication with the casing/tubing annulus of a rod pumped well. A valve is provided downstream of the pump and reagent supply for regulating the flow of the reagent into the water supply conduit. An additional valve, upstream of the junction between the reagent supply line, is provided to regulate water flow within the water supply conduit.

U.S. Pat. No. 2,654,436, issued Oct. 6, 1953 to Willis C. Carlisle et al, teaches the use of a downhole valve in regulating the entry of liquid corrosion inhibitors pumped into the casing/tubing annulus at the surface into the tubing, U.S. Pat. No. 2,884,067, issued Apr. 28, 1959 to Alden S. Harken, provides a well treatment apparatus which utilizes a portion of the flow stream from a producing well for chemical mixing and annular injection purposes. Marken's apparatus includes: a mixing vessel, a timing mechanism and associated valve for regulating the flow of produced liquids to the mixing vessel, a chemical storage tank for supplying treating liquids to the mixing vessel, a chemical pump (described but not shown) for the delivery of treating liquids to the mixing vessel, a float value for regulating the volume of treating liquid delivered to the mixing vessel per treating cycle, and associated flow lines connecting the apparatus to the casing/tubing annulus.

U.S. Pat. No. 4,354,553, issued Oct. 19, 1982 to Clifford J. Hensley, provides a method and apparatus for corrosion control downhole in a borehole. Water separated from the produced well fluids is utilized to flush an inhibitor solution into the casing/tubing annulus. Chemical analysis of the produced water is automatically performed by the apparatus and the rate of flow and concentration of the inhibitor solution adjusted accordingly.

U.S. Pat. No. 4,8.17,722, issued Apr. 4, 1989 to Ralph R. Montfort, Jr. et al, shows an apparatus and method for treating oil and gas wells. The apparatus utilizes a timer-actuated, reciprocating pump to inject treatment chemicals stored in remote tanks into the casing/tubing annulus.

None of the above inventions and patents, taken either singly or in combination, is seen to describe the instant invention as claimed.

SUMMARY OF THE INVENTION

The apparatus of this invention operates in combination with a well having a tubing string extending into the earth's surface for the removal of fluids from a hydrocarbon productive reservoir and a casing string surrounding the tubing string for protective purposes. A suitable treatment fluid storage tank and a mixing vessel are interconnected by a supply line directed through an appropriately sized chemical injection pump for providing an adequate and controlled flow rate. Under static conditions, the mixing vessel will contain a metered amount of treatment fluid in addition to a small volume produced well fluids. Generally, the mixing vessel will remain "fluid packed" prior to the discharge of its contents thereby permitting the premixing of the treatment and flush fluids. The mixing vessel is further connected, by separate flow lines, to both the casing-/tubing annulus and tubing string of a hydrocarbon productive well. A valve, opened and: closed by a remote actuating and timing mechanism, regulates flow through the line connecting the tubing string and the mixing vessel. Treating fluids are delivered to the casing/tubing annulus by opening the valve in this latter line by the actuating and timing mechanism. Pressure exerted by the lift mechanism of the well urges a portion of the produced well fluids past the valve and into the mixing vessel where they may combine with the treating fluid therein. The entry of fluids into the mixing vessel drives a corresponding volume of fluid from the vessel and into the casing/tubing annulus.

Discharge of fluids from the mixing vessel is halted by returning the valve, linking the tubing string and the vessel, to a closed position. Upon closure of the valve, the mixing vessel will be returned to a fluid packed condition whereby the vessel is essentially filled with produced well fluids. A chemical injection pump is activated to deliver a predetermined volume of treatment fluid from the storage tank to the mixing vessel are interconnected by way of the supply line thereby recharging the apparatus for another treatment cycle.

Upon review of the disclosure provided herein, it will come to be appreciated that the chemical treatment of an oil or gas well can be an expensive and time consuming effort. The apparatus of this invention meters treating fluids, introduces such into a well, and automatically performs these operations, reducing the cost and time associated with such treatments thereby allowing the resources of a well operator to be allocated to other more pressing projects.

Accordingly, it is a principal object of the present invention to provide an apparatus for automatically feeding a measured quantity of treating liquid into the casing/tubing annulus of a well.

It is another object of the invention to provide an apparatus for periodically introducing a treating liquid into a well whereby the treating liquid are effectively delivered to all components of the well fluid lifting system.

It is an object of the instant invention to provide an apparatus for treating oil and gas wells which is inexpensive, dependable and fully effective in accomplishing its intended purposes.

These and other objects of the present invention will become readily apparent upon further review of the following specification and drawings.

BRIEF DESCRIPTION OF THE DRAWING

Similar reference characters denote corresponding features consistently throughout the attached drawings.

DETAILED DESCRIPTION OF THE PREFERRED EMBODIMENT

Figure 1:
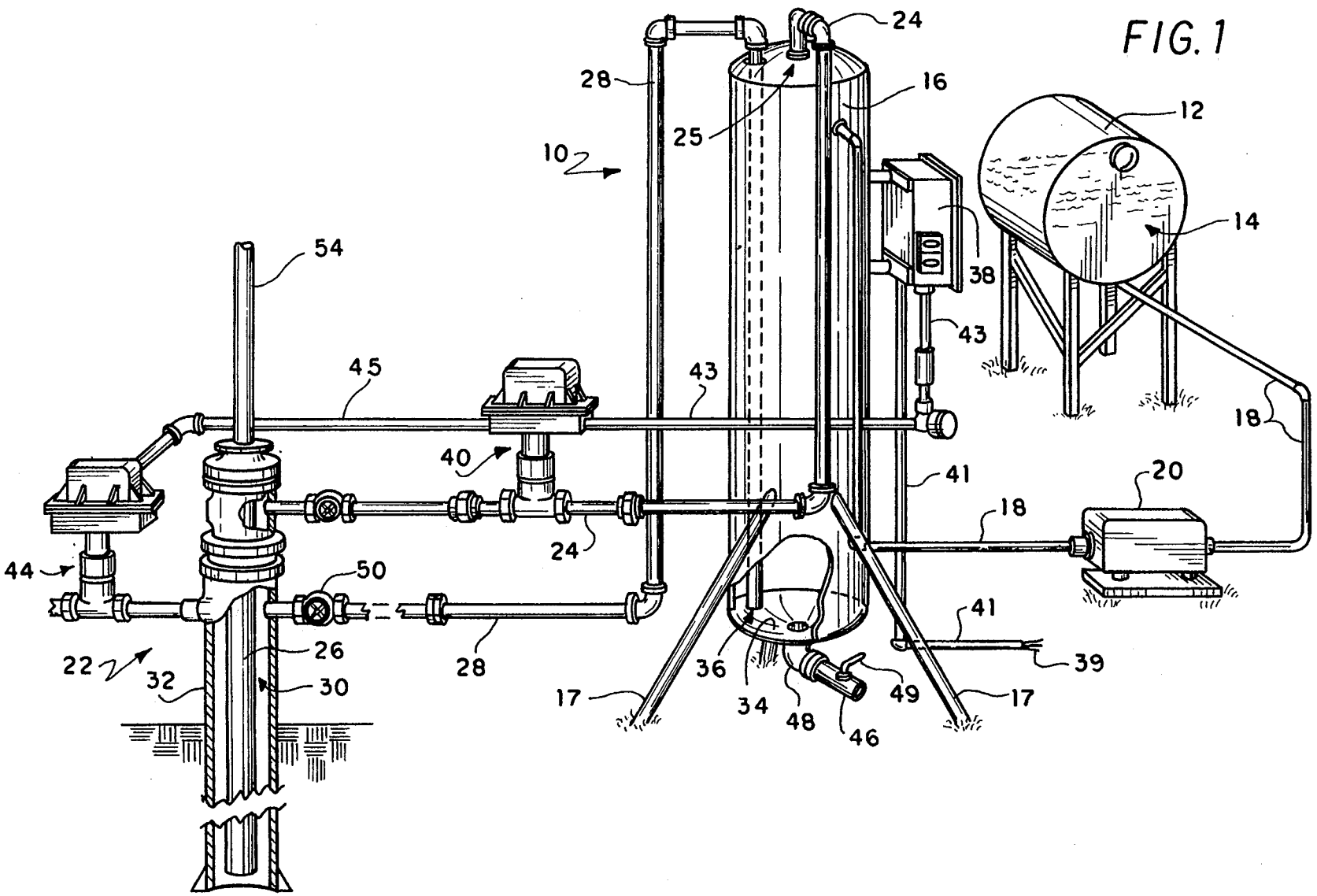
FIG. 1 is a side elevational view partially cut away, of the instant apparatus connected to a well.

In FIG. 1, reference numeral 10 may be seen to represent an apparatus for treating oil and gas wells. Apparatus 10 may be seen to comprise a treatment chemical storage tank 12 which may be any kind of closed container suitable for retaining, without spilling, a chemical treatment fluid 14. Preferably, a metallic, oil drum is utilized for this purpose as such are inexpensive to obtain, nonreactive to most well treatment chemicals, and can withstand severe physical abuse without leakage. Storage tank 12 may be positioned above mixing vessel 16 to permit gravity feed of treatment fluid 14 into mixing vessel 16 through supply line 18. Nevertheless, treatment fluid 14 may be pumped into mixing vessel 16 with the use of a chemical injection pump 20.

Pump 20 is a low volume, reciprocating plunger, chemical injection pump. In the preferred embodiment, Pump Model No. Z-141-151P, hereinafter referred to as the "Z-141 pump", readily available from Milton Roy LMI, a well-known manufacturer of oil field equipment based in Acton, Mass., has been utilized with great success. The Z-141 pump has an independently adjustable stroke length and stroke frequency control permitting pump output to be varied from 0.075 to 5.0 gallons per day at pressures up to 150 psia (10.3 bar). Additionally, solid state electronics of the Z-141 pump have proven to be particularly rugged and accurate in delivering measured quantities of treating liquids to mixing vessel 16. During normal operation, pump 20 is connected directly to an electrical potential source (not shown) and operates continuously, i.e., twenty-four hours per day. Nevertheless, special operations of apparatus 10 may require that pump 20 be controlled by external timer mechanism (not shown) and intermittently utilized. Fluid exiting pump 20 enters supply line 18 in fluid communication with the upper portion of mixing vessel 16.

Mixing vessel 16 comprises a cylindrical and airtight chamber or tank held in an upright orientation above the ground surface by three support legs 17 angularly joined thereto. Support legs 17 may be anchored to the ground surface by poured concrete or cement (not shown) in the usual fashion. Preferably, vessel 16 has height of forty-eight inches, an internal capacity of nine gallons, and is capable of safely containing fluids exerting pressures of 150 psia or less. In field trials, described below, the respective fluid and pressure capacities hereinbefore mentioned have been found to be effective. However, it is realized that well head conditions and treatment requirements vary from well to well and it is anticipated that vessel 1.6 may be modified in either fluid or pressure capacity with no effect upon the proven: performance capabilities of apparatus 10. For instance, high pressure wells not having a packer-isolated casing/tubing annulus would undoubtedly require a mixing vessel having a pressure capacity greater than 150 psia, a pressure rating believed to be most appropriate for wells exhibiting negligible casinghead pressure. Similarly, wells demanding greater volumes of treatment fluid or greater dilution prior to injection may necessitate the use of vessel of greater volume.

Exiting through the top of mixing vessel 16 are two conduits in fluid communication wit:h wellhead 22 of an oil and gas well. Conduit 24 may be seen to join the top of vessel 16 with tubing string 26 whereas conduit 28 may be seen to join mixing vessel with the void or annulus 30 formed between tubing string 26 and casing string 32. Although conduit 24 opens directly into the top of vessel 16 at port 25, conduit 28, on the other hand, extends vertically downward through the top of the vessel to a point proximate its bottom surface 34. Preferably, a gap or space of approximately 1 to 2 inches (2.5 to 5 centimeters) is provided between the bottom of vessel 16 and opening or port 36 in the end of conduit 28 to permit fluid flow from the conduit into the vessel.

Conduit 24 connects tubing string 26 with mixing vessel 16 through valve 40. Valve 40 may be automatically controlled or manually operated. Preferably, an automatic, actuating and timing mechanism 38 is associated with valve 40 in order to regulate the initiation, timing, and completion of the flushing cycle and also the duration of time between subsequent flushing cycles. Actuating and timing mechanism 38, joined to the side of mixing vessel 16 by bracket 42, may be any suitable device for controlling the amount of liquid entering vessel 16. In the preferred embodiment, however, actuating and timing mechanism 38 is a Dayton Multi-operational Timer, known in the industry for its durability and continued accuracy under harsh field conditions. The Dayton Multi-operational Timer is an electrically operated device which ,may be programmed in such a manner so as to open and close one or more mechanical valves at a predetermined time. Electrical power is supplied to mechanism 38 through insulated electrical cables 39 enclosed by protective, metallic tube 41. In the instant apparatus, actuating and timing mechanism 38 is in electrical communication not only with remotely operable valve 40, the associated electrical cables (not shown) extending through protective, metallic tube 43, but also with a similar valve 44 which may be controlled thereby. Valve 40 regulates fluid flow within conduit 24 and, therefore, fluid flow from wellhead 22 into vessel 16. On the other hand, valve 44, joined by electrical cables (not shown) extending through tubes 43 and 45 to mechanism 38, provides a vent for casing/tubing annulus 30.

Apparatus 10 includes two valves for assisting in the cleaning thereof. A drain valve 48 isolates the interior of drain line 48 joined to the bottom of, and in fluid communication with, mixing vessel 16 from the atmosphere. Desirably, valve 46 is a ball valve having an external lever, as at 49, for manually opening and closing the valve. Once opened, liquid within vessel 18 will drain therefrom under the force of gravity and flush sediments or other contaminants that may have settled within vessel 18 from apparatus 10. An additional valve 50, positioned upon conduit 28, isolates casing/tubing annulus 30 from vessel 18. During the previously described draining operation, valve 50 may be employed to prevent pressurized annular fluid from backing into vessel 16.

Apparatus 10 is shown installed upon an oil and gas well utilizing a well-known device for lifting produced fluids to the ground surface. In this regard, reference numeral 54 refers to a polished rod connected to a conventional, downhole, reciprocating pump (not shown). Apparatus 10 may be effectively utilized with wells employing other artificial lift mechanisms including submersible pumps, gas lift, etc., or wells capable of flowing under natural conditions.

In a typical operation of the instant invention, the treating cycle will be initiated with mixing vessel 18 being in a "fluid packed" state whereby produced well liquids essentially fill the entire interior volume of vessel 18. Under these conditions, chemical injection pump 20, in continuous operation, will deliver an increasing volume of chemical treatment fluid 14 through supply line 18 to the upper portion of vessel 18. As treatment fluid 14 is injected into vessel 16, produced well liquid is previously positioned within vessel 16, being incompressible in nature, will be displaced into conduit 28 and drained under a minimal pressure differential into casing/tubing annulus 30. After the desired amount of chemical treatment fluid 14 has been delivered to vessel 16, apparatus 10 is ready to dispense treatment fluid 14 into casing/tubing annulus 30. The dispensing of treatment fluid 14 is accomplished by the automatic opening of valve 40 by actuating and timing mechanism 38. Produced well fluid then flows through conduit 24 into the upper portion of vessel 16, thereby mixing the newly produced fluid with that already within vessel 16 containing a measured volume of treatment fluid 14. Fluids displaced from vessel 16 are driven under pressure, provided by the lifting mechanism of the well, into casing/tubing annulus 30 through conduit 28. The lifting mechanism creates a pressure in piping string 26 that is higher than the pressure in casing string 32. The pressure from piping string 26 forces the displacement of the fluids in vessel 16 by keeping the fluids flowing from piping string 26 through conduit 24, into vessel 16, and out through conduit 28 to casing string 32 and annulus 30, when valve 40 is open. Produced well fluid continues to be introduced into vessel 16 through conduit 24 as long as valve 40 remains open. After a predetermined time, valve 40 is automatically closed by actuating and timing mechanism 38 thereby preventing additional well fluid from entering vessel 16. Vessel 16, remaining in a fluid packed state upon closing of valve 40, is now ready to receive additional volumes of chemical treatment fluid T4 and dispense another slug thereof into casing/tubing annulus 30 upon the later opening of valve 40.

When using instant apparatus, a well attendant simply programs timing and actuating mechanism 38 for the desired well treatment cycle length, establishes the rate of treatment fluid supply from pump 20, and then proceeds to perform other required tasks. As long as the supply of treatment fluid 14 in chemical storage tank 12 lasts, the cycle of feeding treatment fluid 14 to casing-/tubing annulus 30 from vessel 16 may be repeated at the desired regular intervals. For example, mechanism 38 may be set to open valve 40 weekly, daily, or hourly and keep it open for several minutes or hours. Different time cycles may be used for different wells depending upon chemical treatment needs. Without the present invention, the well attendant would be obligated to attend to the well frequently to regulate the chemical treatment thereof.

Field trials, employing the instant apparatus in a variety of oil and gas producing environments, have provided encouraging results. In one well installation, iron sulfide build-up and resultant sub-surface pump sticking was a recurring problem. The operator had initially, and unsuccessfully, attempted to treat the well on an "as needed" basis with batches, varying from five to eight gallons, of a chemical treatment fluid. Chemical treatment fluid usage averaged approximately seventy gallons per month. Upon installation of the instant apparatus, the problem was alleviated in one day, and fluid treatment usage was reduced to three quarts per day or twenty-three gallons per month. In another instance, an operator was experiencing production decline in a number of wells due to paraffin deposition. Initially, periodic and costly, hot oil treatments were utilized by the operator to control the advancing problem. Extensive field tests, however, were performed with the instant apparatus indicating that production levels could be maintained at a high rate with the introduction of one gallon of a relatively inexpensive paraffin solvent/inhibitor solution into the casing/tubing annulus every eight hours. The need for hot oil treatments was eliminated. It should now be appreciated that the instant apparatus can not only assist in maximizing production from a given oil or gas well but, also, in reducing expenses.

While the foregoing device has been described in connection with a particular embodiment, it is not intended to be limited thereto. The device is suitable for treating wells with various treating agents and for various purposes. Obviously, many modifications of the invention may be made without departing from the spirit and scope thereof, and therefore the present invention is not limited to the embodiments described above, but rather encompasses any and all embodiments within the spirit and scope of the following appended claims.

I claim:

1. An apparatus for treating wells having well pipe with a piping pressure, casing pressure, casing with a well casing pressure, and a well annulus defined by the space between the piping and the casing, said apparatus comprising:

a storage tank for retaining chemical treatment fluids;

a Closed and Sealed mixing vessel filled with produced reservoir liquids to establish a liquid fluid packed state, wherein said mixing vessel combines the chemical treatment fluids with the produced reservoir liquids prior to reinjection into the well annulus;

a first conduit for delivering the produced reservoir liquids from the well piping to said mixing vessel, said first conduit having a port opening into the top of said mixing vessel;

a second conduit for delivering chemical treatment fluids from said mixing vessel to the well annulus, said second conduit extending vertically into said mixing vessel and having a port opening proximate to the bottom of said mixing vessel;

a first valve for regulating fluid flow within said first conduit; and an actuating and timing mechanism associated with said first valve and adapted to open and close said first valve, wherein the volume of the produced reservoir fluid introduced into said vessel from the well piping is regulated to maintain the liquid fluid packed state;

wherein the chemical fluids and the produced reservoir liquids in the mixing vessel are delivered to the well annulus when said first valve opens., whereby the piping pressure at said first conduit being higher than the casing pressure at said second conduit forces the displacement of the chemical fluids and the reservoir liquids into the well annulus via said second conduit.

2. The apparatus for treating oil and gas wells according to claim 1, further including:

a chemical injection pump in fluid communication with said storage tank for delivering a chemical treatment fluid to said mixing vessel under pressure.

3. The apparatus for treating oil and gas wells according to claim 1, further including:

a drain line joined to the bottom of, and in fluid communication with, said mixing vessel for flushing sediments or other contaminants from said vessel.

4. The apparatus for treating oil and gas wells according to claim 3, further including:

a drain valve joined to said drain line for isolating the interior of said mixing vessel from the atmosphere.

5. The apparatus for treating oil and gas wells according to claim 1, further including::

a remotely operable valve in electrical communication with said actuating, and timing mechanism for venting the casing/tubing annulus of a well.

6. The apparatus for treating oil and gas wells according to claim 1, further including:

a plurality of support legs angularly joined to said mixing vessel for retaining such in an upright orientation and above the ground surface.

7. The apparatus for treating oil and gas wells according to claim 1 wherein said mixing vessel has a pressure capacity of 150 psia.

8. The apparatus for treating oil and gas wells according to claim 1, further including:

a bracket joined to the side of said mixing vessel for mounting said actuating and timing mechanism,

9. The apparatus for treating oil and gas wells according to claim 1 wherein said mixing vessel comprises an upright, cylindrical, and airtight chamber.

10. An apparatus for treating wells having well piping with a piping pressure, casing with a well casing pressure lower than the piping pressure, and a well annulus defined by the space between the piping and the casing, said apparatus comprising:

a storage tank for retaining chemical treatment fluids;

a sealed mixing vessel filled with produced reservoir liquids to establish a Liquid fluid packed state, wherein said mixing vessel retains the chemical treatment fluids with the produced reservoir liquids prior to reinjection into the well annulus;

a first conduit for delivering the produced reservoir liquids from said well piping to said mixing vessel, said first conduit having a port opening into the top of said mixing vessel;

a second conduit in fluid communication with said mixing vessel for delivering chemical treatment fluids to the well annulus, said second conduit extending vertically into said mixing vessel and having a port opening proximate to the bottom of said mixing vessel;

a first valve for regulating fluid flow within said first conduit; and an actuating and timing mechanism associated with said first valve and adapted to open and close said first valve, wherein the volume of the produced reservoir fluid introduced into said vessel from the well piping is regulated to maintain the fluid packed state;

a chemical injection pump in fluid communication with said storage tank for delivering the chemical treatment fluid to said mixing vessel under pressure;

a drain lime joined to the bottom of, and in fluid communication with, said mixing vessel for flushing contaminants from said vessel;

a remotely operable second valve in electrical communication with said actuating and timing mechanism for venting the annulus; and a plurality of support legs angularly joined to said mixing vessel for retaining such in an upright orientation and above the ground surface, wherein the chemical fluids and the produced reservoir liquids in the mixing vessel are delivered to the well annulus when the first valve opens, whereby the piping pressure at said first conduit is higher than the casing pressure at said second conduit to force the displacement of the chemical fluids into the well annulus via the second conduit.

* * * * *